US008585055B2

(12) United States Patent
Pardo et al.

(10) Patent No.: US 8,585,055 B2
(45) Date of Patent: Nov. 19, 2013

(54) RACING TABLE GAME

(76) Inventors: Leonard P. Pardo, Denver, CO (US); Ramona Pardo, Denver, CO (US)

( * ) Notice: Subject to any disclaimer, the term of this patent is extended or adjusted under 35 U.S.C. 154(b) by 0 days.

(21) Appl. No.: 13/615,574

(22) Filed: Sep. 13, 2012

(65) Prior Publication Data

US 2013/0009361 A1 Jan. 10, 2013

Related U.S. Application Data

(63) Continuation-in-part of application No. 12/930,704, filed on Jan. 14, 2011, now abandoned.

(51) Int. Cl.
*A63F 3/00* (2006.01)

(52) U.S. Cl.
USPC ..... 273/246; 273/239; 273/284

(58) Field of Classification Search
USPC ..... 273/239, 246, 284, 287
See application file for complete search history.

(56) References Cited

U.S. PATENT DOCUMENTS

| | | | | | |
|---|---|---|---|---|---|
| 1,517,113 | A | * | 11/1924 | Greene | 273/146 |
| 2,922,652 | A | * | 1/1960 | Stange | 273/146 |
| 4,062,545 | A | * | 12/1977 | Witney | 273/239 |
| 4,729,568 | A | * | 3/1988 | Welsh | 273/246 |
| 4,986,546 | A | * | 1/1991 | Cerulla | 273/240 |

* cited by examiner

*Primary Examiner* — Vishu K. Mendiratta

(57) ABSTRACT

The present invention comprises a racing table game and method for playing. Game components include, but are not limited to: a table gaming surface having a plurality of lanes with start and finish lines; a plurality of racers; at least two dice; and a plurality of race tickets each corresponding to a racer. In one embodiment of a method of play, game setup and dealer selection occurs. The dealer then randomizes and distributes the race tickets. A player rolls the dice and acts either by paying chip(s) into a purse or moving a racer, as instructed by the dice. Play continues with each player rolling the dice and acting, until a winner is determined with a racer crossing the finish line. That race is over and the purse is divided into shares and distributed to winning ticket holders. When the role of the dealer is transferred, the next race commences.

1 Claim, 5 Drawing Sheets

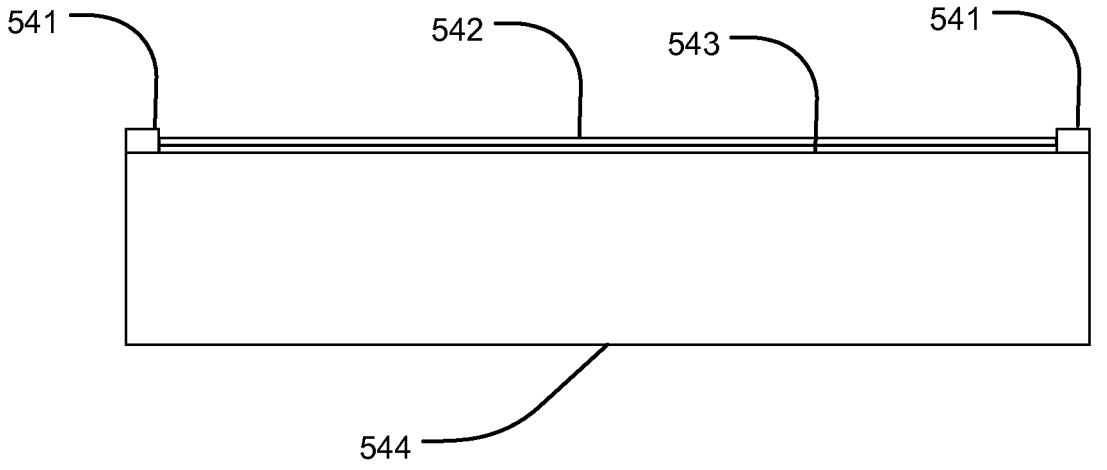
FIG 5
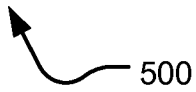

RACING TABLE GAME

CROSS-REFERENCE TO RELATED APPLICATIONS

This application is a continuation-in-part and claims the benefit of U.S. Utility patent application Ser. No. 12/930,704 (filed Jan. 14, 2011) now abandoned entitled Racing Table Game and U.S. Design patent application Ser. No. 12/930,704 (filed on Jul. 13, 2012), which is itself a continuation-in-part of Ser. No. 12/930,704, both of which are specifically incorporated herein by reference for all that they disclose and teach.

TECHNICAL FIELD

This invention relates generally to the field of games and in particular to a racing table game.

BACKGROUND

There are many types of races that humans either participate in directly or orchestrate for their own enjoyment. For example, automobile races and horse races both include a human driver/jockey participating directly in the race while greyhound races have no direct human participant. In either case, the races are about speed and entertainment and are enjoyed by a large and diverse fan base. The fans are those people who are watching, cheering, or otherwise involved in the race but aren't directly participating themselves. Fans often wager on the outcome of a racing event and seek to become more involved with their favorite racing genre through the playing of video games, board games and/or table games that seek to simulate a racing event.

There are a plethora of racing games, for examples, see: U.S. Pat. No. 3,241,279; U.S. Pat. No. 4,357,017; U.S. Pat. No. 5,139,267; U.S. Pat. No. 5,308,078; U.S. Pat. No. 5,551,699; U.S. Pat. No. 5,560,609; U.S. Pat. No. 5,934,673; U.S. Pat. No. 6,464,223; and U.S. Pat. No. 7,118,108; the disclosures of which are herein incorporated by reference in their entirety for all purposes.

However, many such games are either overly complicated, or they do not adequately mirror the excitement and speed of the underlying racing event on which they are based. Specifically, no existing game has the combination of speed, excitement, chips, and player involvement inherent in the present invention.

SUMMARY

Embodiments of the present invention described and claimed herein address the limitations of existing racing games by providing embodiments of an apparatus for a racing table game.

In one embodiment, various game components are utilized as portions of an apparatus for playing a racing table game, comprising: a table gaming surface having a plurality of lanes, a start line, and a finish line; a plurality of racers; at least two dice; and a plurality of race tickets. Another embodiment additionally comprises a plurality of chips. As used herein, the words chip or chips encompass anything that is used to represent 'value' and that is placed (either figuratively or actually) in the pot or purse as the race proceeds. Examples of chips include poker chips, coins, beans, buttons, etc. In one embodiment of a method of play, the game begins when one of the players is designated as "the dealer" and he or she shuffles the race tickets and distributes them to the players. The first player to the dealer's left then rolls at least two dice and either pays chip(s) into the purse (or "pot") or moves at least one of the plurality of racers, depending on the results of the dice roll. The next player to the left then rolls the dice and completes the indicated action; play continuing around the circle of players in a clockwise fashion until one of the plurality of racers reaches the finish position. That race is then declared over and for each race ticket depicting the winning racer that is held by a player, that player receives an equal whole-chip share of the purse. Any remaining chips are left in the purse and become part of the purse for the next race, if any. The role of the dealer is transferred to the player on the current dealer's left and the next race can commence. Other embodiments are contemplated and specifics thereof are explained in the Detailed Description section below.

The present invention provides many benefits over the prior art. Because the game has relatively few rules, the excitement and speed inherent in racing events is captured therein. Furthermore, the players do not have to be overly concerned with complex rules and the game is not constantly interrupted in order to check a rule or explain a step. New players can easily and quickly familiarize themselves with the game and players can come and go without detracting from the gaming experience for the remaining players. Although a preferred embodiment includes game components and a playing method that simulates a horse race event, other racing events are contemplated and can be easily simulated in one or more embodiments of the present invention.

BRIEF DESCRIPTION OF THE DRAWINGS

The aforementioned and other features and objects of the present invention and the manner of attaining them will become more apparent and the invention itself will be best understood by reference to the following descriptions of a preferred embodiment and other embodiments taken in conjunction with the accompanying drawings, wherein:

FIG. 5 illustrates a cross-sectional view of an exemplary embodiment of components for a table game board.

DETAILED DESCRIPTION

Figure 1:
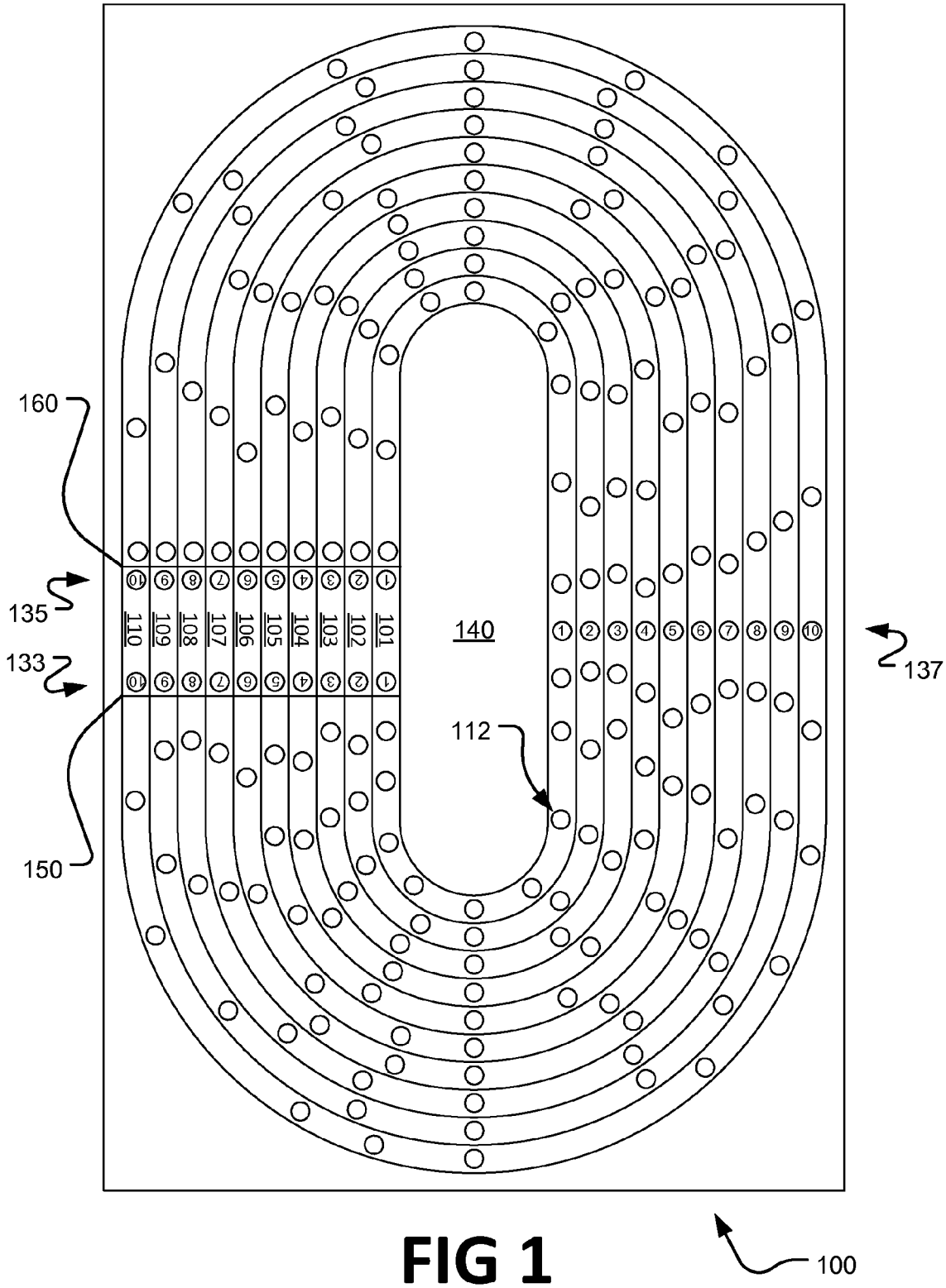
FIG. 1 illustrates a top plan view of an exemplary embodiment of a table game board.

In one embodiment, various game components are utilized as portions of an apparatus that can be used as an entertainment device. An exemplary method for playing a racing table game is described, although other embodiments of methods of play are contemplated. The game components can include, but are not limited to: a table gaming surface; a plurality of racers; at least two dice; a plurality of race tickets; and a plurality of chips. In another embodiment, chips are not included. A table gaming surface can have a plurality of racing lanes in which the racers move throughout the race. The gaming surface can also have a start line on which the racers are placed at the start of the race. Similarly, a finish line can be detailed on the game board as well and when a racer crosses the finish line, a given race can be over. In this embodiment, the plurality of racers can each resemble a horse with a jockey and they are shaped so as to approximately fit within a lane on the table game board. The table game surface can be displayed on top of a game board; the game board having a component which is either itself magnetic or is attracted by magnets (hereafter, a magnetic surface). Layered on top of the magnetic surface is a protective surface, which in a preferred embodiment is an outdoor-quality vinyl sticker. The sticker can serve as the outer layer of the game, i.e, the gaming surface, or it can be transparent and have the gaming surface immediately underneath of it.

As the game progresses, the various racers are moved along on top of or above the gaming surface by the players. At the start of a given race, one of the players is designated as the dealer and he or she shuffles the race tickets and distributes them to all the players, including himself or herself. In another embodiment, the players choose their own race tickets. In yet another embodiment, a portion of the race tickets are randomly distributed and a second portion are chosen by the players. The players take turns rolling the dice. Rolls of the dice dictate which racer is moved as well as how far that racer is moved. Further, the dice also indicate how many chips (or what value chips) a given player has to pay into the purse on a given turn.

In one embodiment, a player either moves a racer or pays into the purse on a given turn. In another embodiment a player can do both actions; in yet another embodiment, a player can take neither action. A given race is over when a racer crosses the finish line. The purse is then divided in equal whole-chip shares, with one share given per race ticket that matches the winning racer. Any remaining chips are left in the purse and become part of the purse for the next race, if any. In one embodiment, eleven racers are used and there are four race tickets that match each of the eleven racers. In another embodiment, there are eight race tickets that match each of the eleven racers. In yet another embodiment, there are ten racers and four race tickets that match each racer. In other embodiments, varying numbers of racers and race tickets can be used. After a given race has ended, the role of the dealer is transferred to the player on the dealer's left and the next race can commence.

FIG. 1 illustrates a top plan view of an exemplary embodiment of a table game board 100. Since the view in FIG. 1 is a plan view, only the top gaming surface of the game board 100 is shown. It is contemplated that a common method of utilizing the game board 100 will be to place it on a table with the players seated/standing around the table. In a preferred embodiment, the game board 100 has a relatively thick side dimension, causing the gaming surface to be elevated above the table surface or whatever surface is supporting the game board 100.

In a preferred embodiment, the table game board 100 has a surface that attracts magnets. In one example, the table game board 100 can utilize outdoor-quality, long-lasting vinyl stickers displaying the game board 100 surface shown in FIG. 1 on top of a metal plate that is attracted by magnets. In other embodiments, paints or other colorings are added to the surface instead of, or in addition to, the vinyl stickers. In yet another embodiment, the vinyl sticker is transparent and the surface shown in FIG. 1 can be seen through the clear sticker. Other embodiments having other types of materials can be used. It is contemplated that the table game board 100 can be constructed as a unitary, non-folding game board 100. Alternatively, the game board 100 could be constructed so as to unfold one or more times. In either case, the game board 100 should lock into a relatively rigid, stable state for game play.

As depicted in the embodiment of FIG. 1, a table game board 100 can have a plurality of racing lanes 101-110, illustrated in FIG. 1 as being generally oval in shape. Other shapes are contemplated, including round, rectangular, etc. The table game board 100 is illustrated in FIG. 1 as having ten separate and distinct racing lanes 101-110 in which the racers move throughout the race. Within each lane 101-110 are a number of race positions 112. In other embodiments, the number of lanes 101-110 can be more than or fewer than ten.

Although the lanes 101-110 appear to be of differing lengths, they each have the same number of race positions 112. The race positions 112 represent locations upon which racers (not shown in FIG. 1, see FIG. 2) are placed as the race proceeds. In the embodiment shown in FIG. 1, each lane contains nineteen race positions 112 plus a starting position 133 and a finish position 135. In other embodiments, the number of race positions 112 can be more or less than nineteen. In yet another embodiment, the starting position 133 can be the same as the finish position 135 such that there is only one position between the start line 150 and finish line 160.

The starting positions 133 are found in a row just behind the start line 150. The start line 150 can be an actual line on the table game board 100 or it can be defined as being just in front of the starting positions 133. Before each race begins, the racers should be placed in the starting position 133 that matches each racer's number (or other unique identifying indicia, color, shape, etc.). In the embodiment of FIG. 1, there are ten lanes 101-110 numbered one through ten and labeled 101 through 110. Each lane 101-110 has a starting position 133 represented by a circle with the corresponding lane number (one to ten). Similarly, each lane 101-110 has a finish position 135 represented by a circle with the corresponding lane number (one to ten). The finish positions 135 are located after the finish line 160 (between the finish line 160 and the start positions 133). The finish line 160 can be an actual line on the table game board 100 or it can be defined as being just in front of the finish positions 135 so that the racers cross the finish line 160 as they are moved onto the finish positions 135. Opposite the start line 150 and finish line 160, located at approximately the half-way-point in each lane 101-110, are the mid-way positions 137 also represented by circles containing lane numbers (one to ten). In other embodiments, the number of lanes 101-110 and racers can be fewer than or more than ten. Similarly, the number of racing positions 112 can be fewer than or more than nineteen.

The table game board 100 in the embodiment illustrated in FIG. 1 has a start line 150 behind which the racers are placed at the start of the race. The racers are described in more detail in FIG. 2, see below. Each racer has a means for maintaining its location on the game board. In a preferred embodiment, each racer has a magnet that allows it to 'stick' to the table game board 100. In other embodiments, other means for maintaining locations are contemplated, including: hook-and-loop material, matching indents and protrusions, etc. To begin the game, each racer is placed in its starting position 133. In other embodiments, handicaps can be employed, where racers are started in positions further down their respective lanes.

Each racer has an identifying indicia, color, shape, etc. that allows it to be uniquely identified by the players. Each lane 101-110 has a corresponding indicia, color, shape, etc. that allows each racer to be matched with its lane 101-110. Once each racer is correctly positioned on its starting position 133, game play can commence. In another embodiment, one or more racers can be placed in various race positions 112 rather than on a start position 133 before a race begins. This can be done as a means of handicapping a given race.

Game play commences according to embodiments of a method of playing the game as described in detail under FIG. 4, below. A given race is over when a racer crosses the finish line 160 and is placed in its finish position 135. In other embodiments, the race continues until one or more of Second Place, Third Place, etc. are determined. In yet another embodiment, a given race can have more than one "lap" such that the race is not over until a racer crosses the finish line 160 twice, thrice, etc. A variation of this embodiment can have one or more Places as well, such as Second Place, Third Place, etc.

Also shown in FIG. 1 is the centerfield 140. This area of the game board 100 can be used to store extra game components, to hold the purse (i.e., the collection of chips that builds as the race is run), etc.

Figure 2:
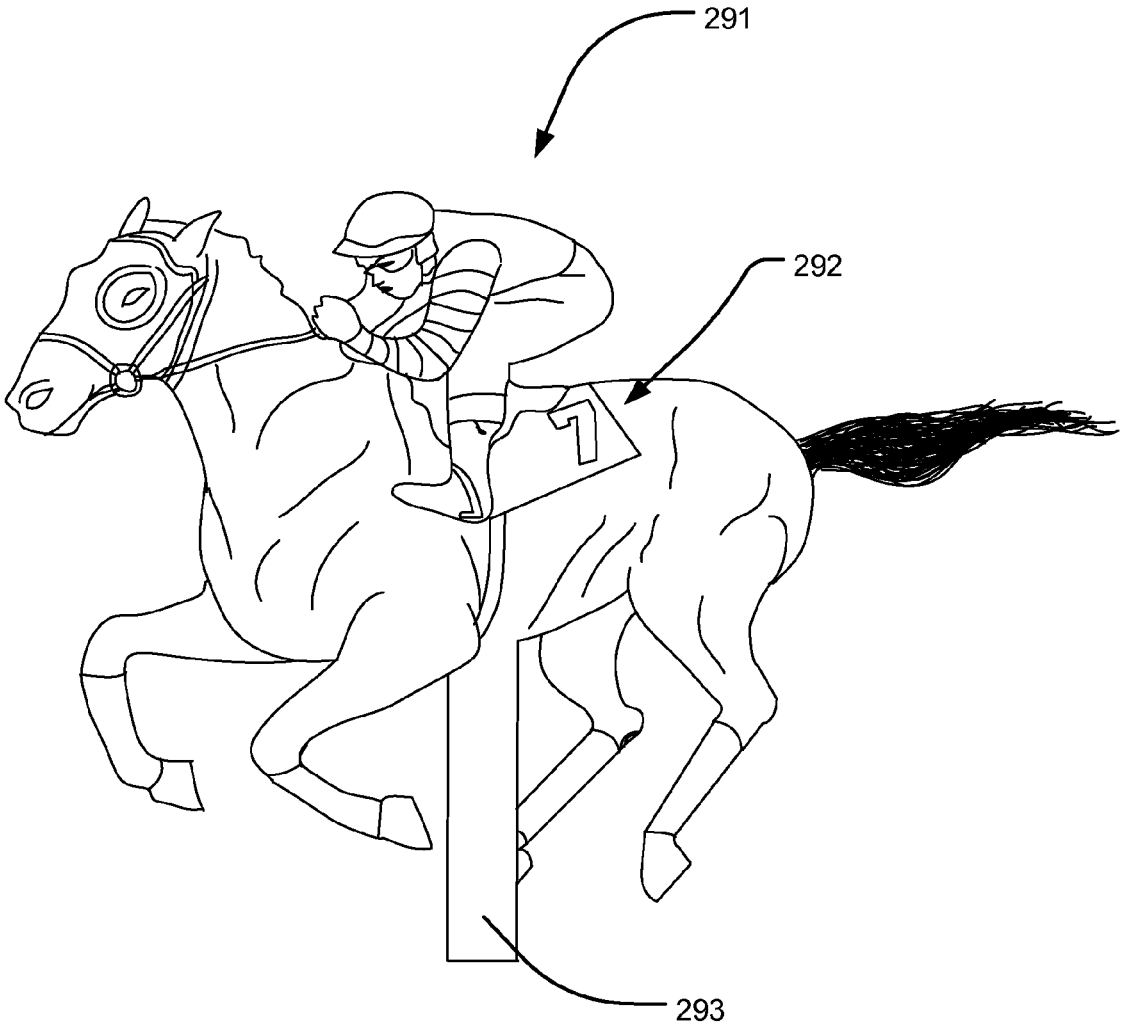
FIG. 2 illustrates a close-up elevation view of an exemplary embodiment of a racer.
Figure 2:
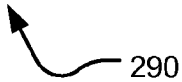

FIG. 2 illustrates a close-up elevation view of an exemplary embodiment of a racer 290. The racer 290 shown in FIG. 2 resembles a horse and rider (or jockey). In other embodiments, the racer 290 can resemble automobiles, greyhounds, or any other race participant, etc. In yet another embodiment, the racer 290 does not resemble a race participant, but is instead simply a place holder signifying a racer. As illustrated in FIG. 2, the racer 290 includes a representation of a jockey 291. The racer 290 also has identifying indicia 292 which is illustrated in FIG. 2 as being a number seven. In other embodiments, other types of identifying indicia, colors, shapes, etc. are utilized to make each racer 290 unique among a given set of game components. Each racer 290 has a retention means 293 for maintaining its location on the game board 100. In a preferred embodiment, the retention means 293 comprises a magnet that allows the racer 290 to magnetically 'stick' to the table game board 100. Thus, if the game board 100 is bumped or shifted, the racers 290 remain in position and the game continues uninterrupted. In other embodiments, other retention means 293 are contemplated, including, but not limited to: hook-and-loop material, matching indents and protrusions, etc. In yet another embodiment, the game board 100 can be magnetic and the retention means 293 can be any material that is attracted by a magnet.

Figure 3:
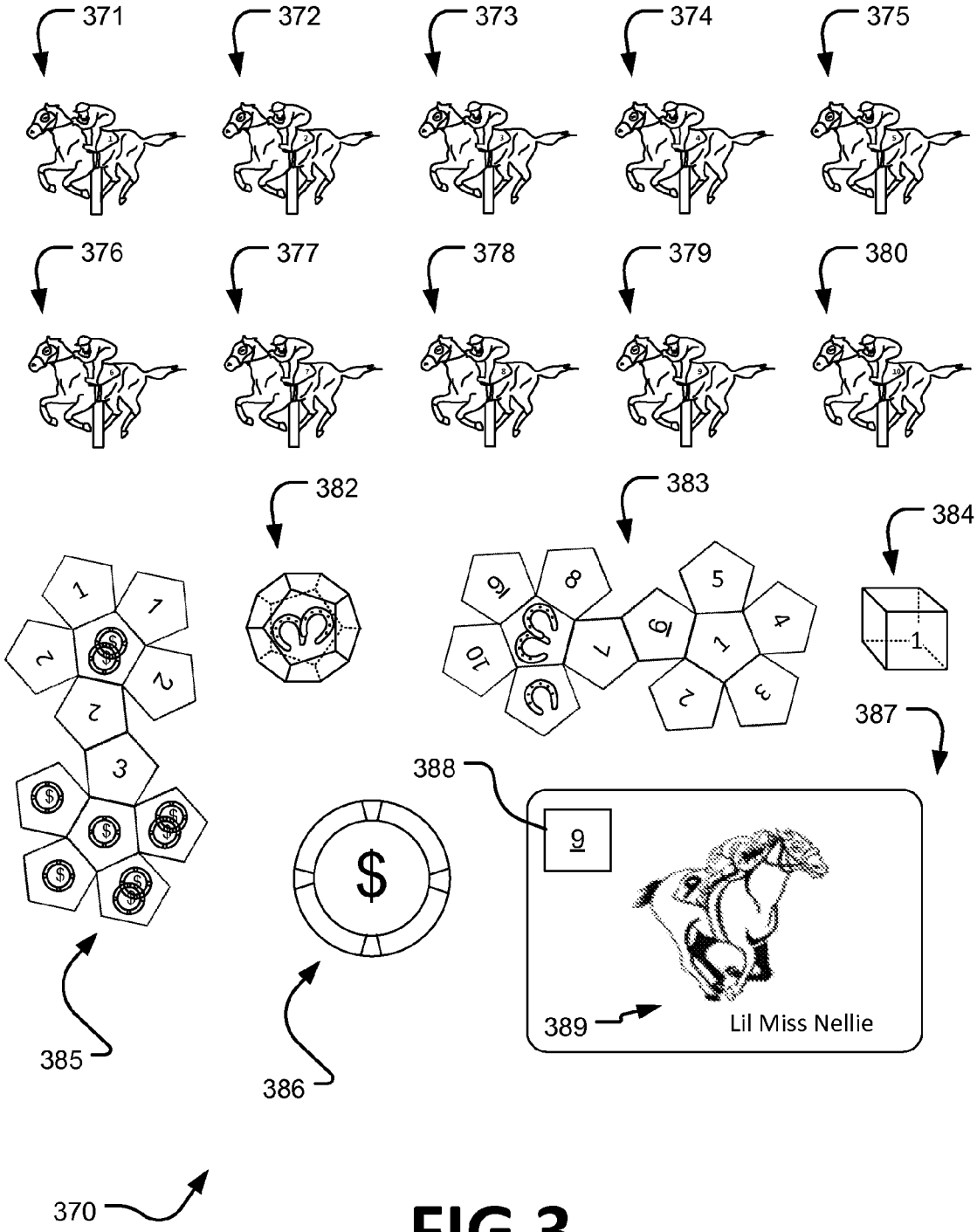
FIG. 3 illustrates an exemplary embodiment of various game components suitable for use as part of the present invention.

FIG. 3 illustrates an exemplary embodiment of various game components 370 suitable for use as part of the present invention. Racers 371-380 are illustrated, each having identifying indicia that make them unique. For more detail concerning the racers 371-380 see the close-up view in FIG. 2.

The components 370 also include at least two dice. The first and second depictions of die 382 and 383 shown in FIG. 3 are twelve-sided regular dodecahedrons. In other embodiments, other types, sizes, shapes, colors, etc. of dice are contemplated. The first die depiction 382 shows a dodecahedron having a front face with a representation of two horseshoes (or double horseshoes). The remaining eleven faces contain no indicia in the illustration in FIG. 3 in order to keep the FIG. from being confusing. Dashed lines in the first die depiction 382 represent the lines of the faces of the dodecahedron that can not be seen from the viewing angle depicted in FIG. 3.

The second die depiction 383 is shown with all of its faces laying flat so that it is clear that each face is generally a pentagon in shape and if each side of each pentagon is attached to its neighbor, a three-dimensional dodecahedron results. The second die depiction 383 has faces numbered one through ten, each corresponding to a lane 101-110 and a racer 371-380. The eleventh face has a depiction of a single horseshoe which can represent any number of actions/moves. In one embodiment, the player single horseshoe refers to the racer 371-380 that is in last place, in another embodiment it is a "wild-card" roll and the player who rolls the single horseshoe can choose which racer 371-380 he or she wishes to advance. In other embodiments, other "wild-card" type associates can be made between various actions and the single horseshoe. Similarly, the twelfth face has a depiction of two horseshoes which represents a "wild-card" roll and allows the player who rolls the horseshoes to choose which racer 371-380 (or the last place racer) he or she wants to move. In other embodiments, the single and/or double horseshoes can be replaced by any other picture, symbol, etc.

A third die depiction 384 shows a standard, six-sided die with a front face labeled "1". This is a common die and can be numbered 1, 1, 1, 2, 2, 3 so that it is twice as likely to roll a "2" versus a "3" and three times as likely to roll a "1" as a "3". The third depictions 384 can be compared to the first and second depictions 382 and 383 in order to better understand the shape and function of a twelve-sided die.

In another embodiment, a common die is not used and two twelve-sided dice are used instead. A second twelve-sided die 385 is shown in FIG. 3. As discussed above, a first die is numbered one through ten on its first ten faces and has a representation of on horseshoe on its eleventh face and two horseshoes on its twelfth face. In an embodiment where a second twelve-sided die is employed, it can have a number of faces with a "1" on them, a second number of faces with a "2" on them, a third number of faces with a "3" on them, a fourth number of faces with a single "chip", and a fifth number of faces with a double "chip". For example, see FIG. 3, item 385 for a die with two faces displaying a "1", three faces displaying a "2", one face displaying a "3", three faces displaying a single "chip", and three faces displaying a double "chip". In other embodiments, the number of faces displaying each of these indicia can vary as can the indicia themselves.

The chip 386 in FIG. 3 is for illustration only; there are a plethora of different sizes, shapes, colors, etc. for chips known in the art. In other embodiments, the chips can be replaced by any other pictures, symbols, etc. Furthermore, the number of "1"s, "2"s, "3"s, single chips and double chips displayed on the die faces can vary without departing from the scope of the invention. In another embodiment, the second die can include one or more "4"s, "5"s, "6"s, etc.; or it may not have any "1"s, "2"s, "3"s, etc. Variations in the number of numbers and chips shown on the second dice is contemplated.

The race ticket 387 shown in FIG. 3 is just one of a plurality. Each race ticket 387 should have an identifying indicia 388 such as the number nine shown in FIG. 3. Further, each race ticket 387 can have a depiction of a racer 389 in addition to, or instead of, the identifying indicia 388. The race tickets are generally shaped and sized like standard playing cards, although as above, wide variation of dimensions is within the scope of the invention.

Figure 4:
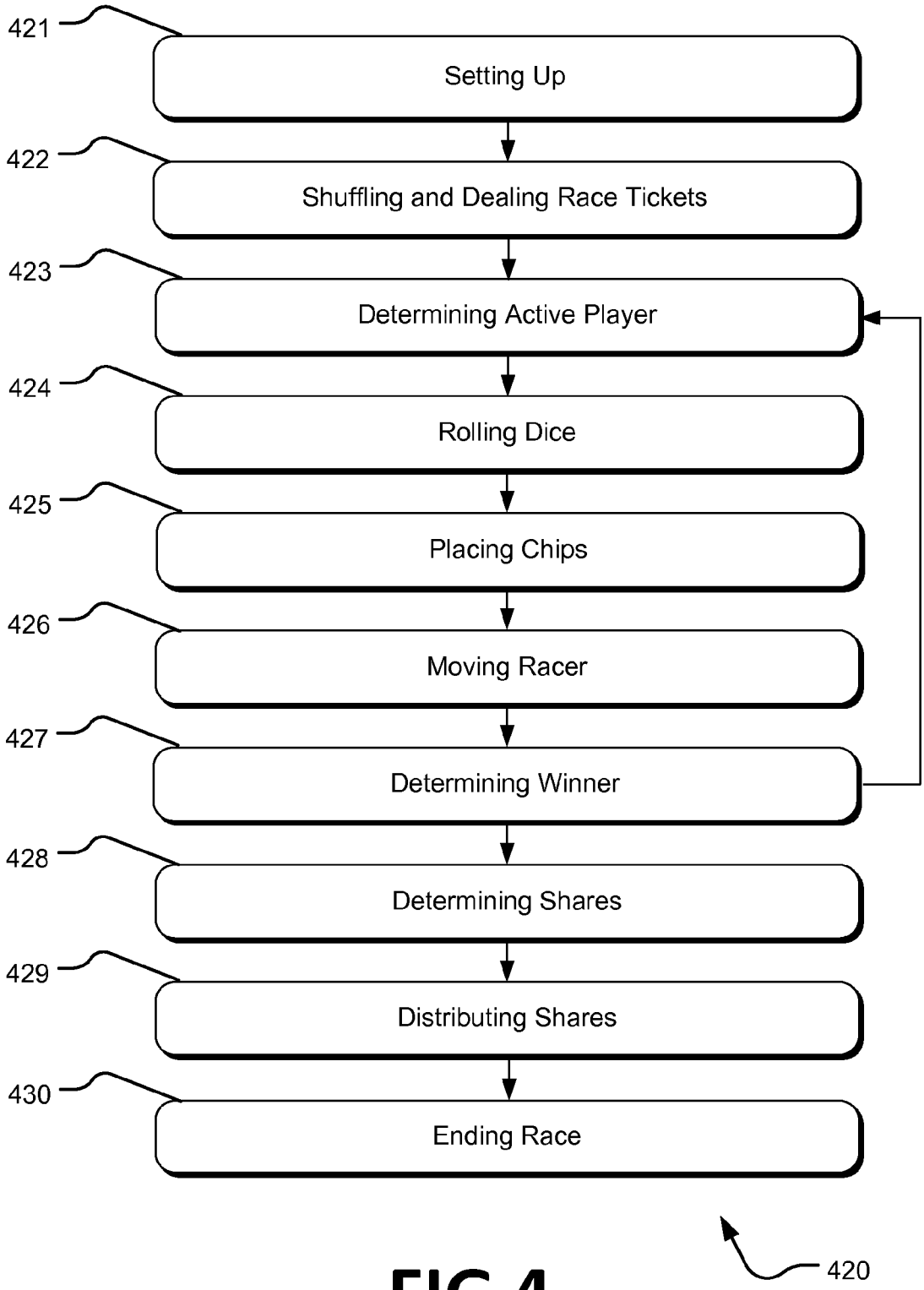
FIG. 4 illustrates an exemplary embodiment of a method for playing a racing table game.

FIG. 4 illustrates an exemplary embodiment of a method for playing a racing table game 420. The method 420 comprises the following steps: setting up 421, shuffling and dealing race tickets 422, determining active player 423, rolling dice 424, placing chips 425, moving racer 426, determining winner 427, determining shares 428, distributing shares 429, and ending race 430.

Before a given race is started, the game board needs to be set up. The setting up step 421 involves arranging the racers on the game board (e.g., placing racer one on starting position one, racer two on starting position two, etc.), determining who will be playing the game (i.e., the players), determining which of the players will be the dealer (if any), and deciding how many of the race tickets to use. In one exemplary game embodiment, ten players wish to play and ten racers are to be used. Thus, the setting up step 421 involves placing each of the ten racers, numbered one through ten, on their corresponding starting position. Further, one of the ten players is chosen as the dealer and he or she decides to employ forty of the race tickets. In one embodiment, the game rules dictate the number of race tickets to use based on the number of players;

in another embodiment, the dealer can make this choice. In yet another embodiment, no dealer is used and instead players select their own race tickets and someone is chosen to start the game.

The shuffling and dealing race tickets step 422 involves the dealer gathering the selected number of race tickets (in the example above, forty), randomizing them (usually done by shuffling them face down so no one can see the identifying indicia on the race tickets), and distributing them out to the players (again performed face down). Dealing should begin with the person to the dealer's left, should continue to the next player to the left and so on, should continue around to each person sequentially in order, and should give only one race ticket per person each time around. Continuing the example above, each of the ten players (including the dealer) receives four of the race tickets. If there were fewer than ten players and forty race tickets were used, some players may end up with more race tickets than others—this is acceptable. In one embodiment, if the number of players is ten or fewer, forty race tickets can be used; if the number of players is eleven or more, eighty or more race tickets are used.

In the determining active player step 423, the first player clockwise from the dealer (i.e., to the dealer's left) is initially selected as the active player. In another embodiment, there is no dealer, so a first player is selected from among all players. In later rounds, the determining active player step 423 involves simply choosing the player to the left (i.e., clockwise) of the previously active player.

In the rolling dice step 424, the active player rolls the dice. In one embodiment, two twelve-sided dice are used. The roll results in the first die showing a single upwards face having a "1", a "2", a "3", a single chip, or a double chip displayed. The roll also results in the second die showing either a number one through ten or a single or double horseshoe. As discussed in detail above, other numbers, chips, symbols, etc. can be used in other embodiments. Furthermore, the dice are not limited to dodecahedrons, other dice can be used.

In the placing chips step 425, if the first die resulted in a single chip being displayed then the active player would place a single chip in the purse or pot. If the first die resulted in a double chip, the active player would place two chips in the purse (or a chip having double the value of a single chip). If neither a single nor a double chip resulted from the first die, then the placing chips step involves the active player placing zero chips in the purse.

In the moving racer step 426, if the first die resulted in a single or double chip being displayed then no action is taken in this step. However, if the first die resulted in a "1", a "2", or a "3" being displayed, then the second die needs to be consulted. If the second die has a number from one to ten then the active player moves the corresponding racer (numbered one to ten) forward the number of positions displayed by the first die (i.e., "1", "2", or "3" positions). If instead, the second die displays the single or double horseshoes, then the active player employs a wild card move, as discussed above. In one case, the player can choose which racer he or she would like to advance the number of positions displayed in the first die. In another embodiment, if the double horseshoe is displayed, then the last place horse is moved forward.

In one embodiment, if a wild card is displayed, the active player can only choose to move a racer forward the exact number of positions dictated by the first die. For example, if a given racer is only two positions from the finish position and the first die displays a "3", then the active player can not choose to move that racer and must instead select another racer to advance. In another embodiment, a player can select any racer, even one which would result in moving 'past' the finish position. Similarly, in one embodiment, if the second die indicates a specific racer (one through ten) and the first indicates a number of positions that must be moved that is greater than the number of positions remaining, the racer is advanced regardless; in another embodiment, the racer is not advanced.

In the determining winner step 427, the dealer examines the position of each racer. If no racer has passed the finish line then the dealer determines that the race continues. If a single racer has passed the finish line, the dealer declares that racer the winner. In another embodiment, the race continues until the dealer determines the Second Place racer, the Third Place racer, etc. In yet another embodiment, a given race can have more than one "lap" such that the race is not over until a racer crosses the finish line twice, thrice, etc. A variation of this embodiment can have one or more Places as well, such as Second Place, Third Place, etc. If the dealer determines that the race continues, then the determining active player step 423 is initiated and the race continues through steps 424, 425, 426 and 427 until a determining winner step 427 occurs wherein the dealer determines a winner (or Second Place, Third Place, etc. as required by the embodiment being played).

In the determining shares step 428, each player shows each of his or her race tickets that depict the winning racer, these are counted up and a total number of winning tickets (a ticket total) is found. Then the total number of chips in the purse (or pot) is added up to get a purse total and the purse total is divided by the ticket total, the resulting number is called the purse share. If the chips divide evenly and the purse share is a whole number, then the resulting number is declared the share amount. If the chips do not divide evenly and the purse share is not a whole number, then the purse share is rounded down to the next whole number and that number is declared the share amount. For example, suppose racer three is determined as the winner and there are four race tickets being held by the players that depict racer three. The total number of chips in the purse is two hundred and three. Dividing that total by the number of winning race tickets (203 divided by 4) results in fifty and three-quarters as the purse share. Since that is not a whole number, the purse share is rounded down and the declared share amount is fifty.

In other embodiments, additional Places also receive a portion of the purse. For example, those players holding race tickets depicting the Second Place racer could receive one third of the total purse and two thirds would go to those players holding race tickets depicting the winning racer. Once again only whole number chips would be split, any remainder would be left in the purse for the next race. Determination of the shares would then be handled as above. This scenario could of course be expanded to pay Third Place, Fourth Place, etc. with the split percentages being between and including zero and one hundred percent.

In the distributing shares step 429, each player receives a share amount of the chips from the pot for each winning race ticket he or she holds. Any chips that remain in the purse after all of the share amounts have been distributed are left in the purse and become part of the purse for the next race, if any. Continuing the above example, player five holds one race ticket depicting the winning racer, racer three. Player seven holds two race tickets depicting racer three and player eight holds one race ticket depicting racer three. In the distributing shares step 429, player five would receive one share amount or fifty chips, player seven would receive two share amounts or one hundred chips, and player eight would receive one share amount of fifty chips. The remaining three chips would be left in the purse for the next race.

In the ending race step 430, the dealer declares that all the shares have been paid, the purse is set for the next race and the current race has officially completed.

FIG. 5 illustrates a cross-sectional view of an exemplary embodiment of components for a table game board 500. The components include a raised edge 541, a magnetic surface 543, a protective surface 542, and a support 544. As discussed above, the magnet surface 543 can be itself magnetic or it can be a material that is attracted by magnets. The protective surface 542 can be outdoor-quality vinyl on which is printed the game board surface 100 as depicted in FIG. 1. The raised edge 541 can be arranged around the exterior of the board to help keep the pieces on the board. The support 544 holds up the game board 500 and provides structural security.

As mentioned above, in one embodiment, a racing table game could simulate horse racing; in another embodiment, a greyhound race is simulated; in yet another embodiment, an automobile race is simulated. In a greyhound race, the double horseshoes could be a double bone, dog paw print, etc.; and the racers could look like greyhounds. In an automobile race, the double horseshoes could be two tires, a set of car-racing finish flags, etc.; and the racers could look like automobiles. The present invention can similarly simulate other racing events.

The above specification, examples and data provide a description of the structure and use of exemplary embodiments of the described articles of manufacture and methods. Many embodiments can be made without departing from the spirit and scope of the invention.

What is claimed is:

1. An apparatus to be employed for entertainment purposes, the apparatus comprising:

a game table having a protective surface and a magnetic surface underneath the protective surface, and wherein the protective surface is a vinyl sticker that extends in two dimensions in a generally horizontal plane and the magnetic surface extends in two dimensions and is parallel thereto;

the game table further comprising a raised edge along a perimeter of the vinyl sticker and the magnetic surface resting upon a support;

the vinyl sticker having a plurality of lanes arranged in a generally oval configuration, and a start line and a finish line arranged in proximity to one another with the start line at the beginning of the plurality of lanes and the finish line at the end of the plurality of lanes;

the vinyl sticker is designed so as to support a plurality of racers thereon and wherein the plurality of racers each resemble a horse and a jockey riding on the horse in combination, and each having a magnetic base attached to the horse that operates in combination with the magnetic surface to removably attach the plurality of racers to the vinyl sticker;

a plurality of race tickets, wherein each of the plurality of race tickets has a depiction of one of the plurality of racers;

a plurality of dice, wherein a first die is a dodecahedron having faces corresponding to the plurality of racers plus a first wild-card face, and a second wild-card face, and a second die has at least a first face displaying a 1, a second face displaying a 2, a third face displaying a 3, a fourth face representing a single chip, and a fifth face representing a double chip;

a plurality of game chips; and a purse comprising one or more of the plurality of game chips.

* * * * *